US008459317B2

(12) United States Patent
Hu

(10) Patent No.: US 8,459,317 B2
(45) Date of Patent: Jun. 11, 2013

(54) HAND-CRANKED PENCIL SHARPENERS

(75) Inventor: Jingyi Hu, Shenzhen (CN)

(73) Assignee: Yurisheng Electronic (Shenzhen) Co., Ltd., Shenzhen (CN)

( * ) Notice: Subject to any disclaimer, the term of this patent is extended or adjusted under 35 U.S.C. 154(b) by 344 days.

(21) Appl. No.: 12/849,702

(22) Filed: Aug. 3, 2010

(65) Prior Publication Data

US 2011/0226383 A1 Sep. 22, 2011

(30) Foreign Application Priority Data

Mar. 17, 2010 (CN) ..... 2010 1 0131301

(51) Int. Cl.
*B43L 23/00* (2006.01)

(52) U.S. Cl.
USPC ..... 144/28.1; 144/28.11; 144/28.6; 144/28.8

(58) Field of Classification Search
USPC ..... 144/28.1, 28.11, 28.3, 28.6, 28.8, 144/28.9
See application file for complete search history.

(56) References Cited

U.S. PATENT DOCUMENTS

| | | | | | |
|---|---|---|---|---|---|
| 673,770 | A | | 5/1901 | Fortunati | |
| 836,712 | A | | 11/1906 | Rush | |
| 1,160,091 | A | | 11/1915 | Stewart | |
| 1,887,843 | A | | 11/1932 | Ludwig | |
| 1,902,844 | A | | 3/1933 | Fiset | |
| 2,561,438 | A | | 7/1951 | Duchesneau | |
| 2,572,875 | A | * | 10/1951 | Markvart et al. | 144/28.71 |
| 2,593,649 | A | * | 4/1952 | Basson | 144/28.8 |
| 2,615,426 | A | * | 10/1952 | Fryer | 144/28.6 |
| 2,624,317 | A | * | 1/1953 | Tall | 144/28.71 |
| 2,915,271 | A | * | 12/1959 | Ruttger | 248/206.3 |
| 3,004,522 | A | | 10/1961 | Kent | |
| 3,556,182 | A | | 1/1971 | Tanigami | |
| 3,650,308 | A | | 3/1972 | Hori | |
| 3,678,975 | A | | 7/1972 | Imanishi et al. | |
| 3,746,061 | A | | 7/1973 | Nakazaki | |
| 3,965,949 | A | | 6/1976 | Aston et al. | |
| 4,050,487 | A | | 9/1977 | Mabuchi et al. | |
| 4,759,129 | A | * | 7/1988 | Alpha | 30/452 |
| 4,815,507 | A | | 3/1989 | O'Rourke | |
| 4,918,816 | A | | 4/1990 | Alpha | |
| 4,966,208 | A | | 10/1990 | Uang | |
| 5,379,817 | A | | 1/1995 | O'Neil et al. | |
| D377,666 | S | | 1/1997 | Yuen | |
| 5,894,669 | A | | 4/1999 | Luttgens | |
| 6,065,514 | A | | 5/2000 | New | |

FOREIGN PATENT DOCUMENTS

| | | | |
|---|---|---|---|
| DE | 964574 | C | 5/1957 |
| DE | 202007010551 | U1 | 12/2008 |

OTHER PUBLICATIONS

Office Action dated Mar. 25, 2011 for German Patent Application No. 102010027583.2-27 (3 pages).

* cited by examiner

*Primary Examiner* — Bena Miller
(74) *Attorney, Agent, or Firm* — Perkins Coie LLP

(57) ABSTRACT

Disclosed is a hand-crank pencil sharpener, comprising a housing and a gearing member and a sharpening member which are installed within the housing. The gearing member is connected to a hand crank and transmits a rotation of the crank to the sharpening member. A vertical feeding path is provided for a pencil to be inserted into the sharpening member. The hand-crank pencil sharpener further comprises a feeding member in the feeding path. The gearing member comprises a gearing branch for driving the feeding member. The inserted pencil is fed into or withdrawn from the sharpener automatically by a linkage of the gearing branch and the feeding member when the crank is rotated clockwise or counterclockwise.

18 Claims, 6 Drawing Sheets

HAND-CRANKED PENCIL SHARPENERS

TECHNICAL FIELD

The present application relates to a hand-cranked pencil sharpener, in particular, to a hand-cranked pencil sharpener for sharpening a pencil having a diameter of various sizes.

BACKGROUND

Generally, pencil sharpeners can be classified into electric pencil sharpeners and manual pencil sharpeners. Since the electric pencil sharpeners are not frequently used for sharpening pencils, they usually keep in a standby condition, which will consume powers of the batteries and is not environment protective. Conversely, hand-cranked pencil sharpeners are in a large market demand since they do not require any power supply and are compact and portable.

In prior hand-cranked pencil sharpeners, only a sharpening member is provided. When a crank is operated manually to rotate, a gearing transmits the rotation of the crank to the sharpening member so that a tip of the pencil can be sharpened. For example, there is disclosed a hand-cranked pencil sharpener that comprises a crank, an intermittent wheel, a turnplate, a positioning tube, a toolrest and a blade in Chinese Patent Application No. 90200543.X. The intermittent wheel, the turnplate, the toolrest and the blade are driven by the crank rotated by hand, so that the toolrest and the blade are reciprocated on a bump orbit having a 65° slope, as an alternative of the conventional threaded blades for sharpening pencils. In such a design, a pencil is positioned on the sharpening member and then fed into the sharpeners by gravity in theory. However, in practice, it is difficult to keep the pencil positioned on the sharpening member in position to be properly sharpened if it is not pressed by hand, since it is light and cannot resist the sharpening force applied by the blade. Therefore, the sharpening quality of the pencil sharpener cannot be ensured.

In the case that the pencil is not fed by gravity, for example, if the pencil is put into the sharpening member from a side of the pencil sharpener, the pencil needs to be held and fed by hand when the blade is rotated with the crank in the sharpening. Alternatively, a pencil clamp can be provided at an input of the sharpening member when the sharpening member is rotated by the crank, and apply a clamping force on the pencil so that the pencil is prevented from dropping and can be drawn into the sharpening member gradually by a spring in the pencil clamp. However, it is instable to hold and feed the pencil by hand, resulting that the pencil is easy to be broken off. As for the pencil clamp design, the feeding force applied by the spring is not adjustable and the pencil clamp has to be removed from the pencil sharpener before the pencil is to be sharpened. Such configurations are also not capable of ensuring the sharpening quality and make the pencil sharpener inconvenient to be used.

SUMMARY

The present application provides a hand-crank pencil sharpener for sharpening a pencil through a rotation of the crank by hand, the pencil being fed into and withdrawn from the sharpener automatically.

According to an embodiment of the present application, a hand-crank pencil sharpener comprises a housing and a gearing member and a sharpening member which are installed within the housing. The gearing member is connected to a hand crank and transmits a rotation of the crank to the sharpening member. A vertical feeding path is provided for a pencil to be inserted into the sharpening member. The hand-crank pencil sharpener further comprises a feeding member in the feeding path. The gearing member comprises a gearing branch for driving the feeding member. The inserted pencil is fed into or withdrawn from the sharpener automatically by a linkage of the gearing branch and the feeding member when the crank is rotated clockwise or counterclockwise.

In a preferred embodiment, the feeding member may comprise a feeding gear set driven by the gearing branch, and a pair of feeding rubber tyres driven by the feeding gear set. The pair of feeding rubber tyres may be mounted on two actuation shafts, respectively. The actuation shafts may be connected by at least one resilient member for adjusting an interval between the feeding rubber tyres so that pencils with various diameters are able to be inserted and pre-tightened.

The resilient member may connect ends of the actuation shafts so that the pencil can be fed automatically and transmitted in a vertical feeding path smoothly. The two actuation shafts may be supported by arc guides, which are of a pair of vertical fixed walls and connected at the top thereof via a baffle. A feeding opening is provided in the baffle aligned with a midline of the pair of feeding rubber tyres.

The feeding member may further comprise a slider for keeping the actuation shafts in a same horizontal position when they move upwards or downwards to adapt for pencils with different diameters, so that the engagement of the feeding gear set and the gearing branch is ensured.

In a preferred embodiment, the hand-crank pencil sharpener may further comprise a removable waste box under the sharpening member, so that wastes obtained by sharpening the pencil drop into the waste box to keep the environment clean.

In a preferred embodiment, the pencil sharpener can be fixed on a desk by a fixing member so that the crank can be rotated conveniently with less force. The housing may comprise a bottom plate, a support extending upward from the bottom plate, and a division plate parallel with the bottom plate. A fixing member may be combined with the bottom plate. The fixing member may comprise an adjusting rod, a fixing plate mounted on the adjusting rod via a sleeve, and a knob for adjusting a distance between the bottom of the pencil sharpener and the fixing plate.

Thus, the pencil to be sharpened can enter the sharpening member along the vertical feeding path automatically under an effect of the feeding member. The user only needs to insert the pencil into a corresponding opening. According to the hand-crank pencil sharpener of the present application, the sharpening quality is less affected by hand feeding and thus improved as compared with the prior art, while the structure of the feeding member is also simplified.

Furthermore, in various specific embodiments, the feeding member may comprise a feeding gear set driven by the gearing branch and a pair of feeding rubber tyres driven by the feeding gear set. The pair of feeding rubber tyres may be mounted on two actuation shafts, respectively. The actuation shafts may be connected by at least one resilient member for adjusting an interval between the feeding rubber tyres so that pencils with various diameters are able to be inserted and pre-tightened. In this case, the resilient member can deform according to the actual size of the pencil to be sharpened and thus the distance between the feeding rubber tyres is adjusted automatically. Thus, the pencil can be fed into and withdrawn from the pencil sharpener automatically with a proper pre-tightening force applied thereto. As a result, pencils with different diameters can be suited to be sharpened by the pencil sharpener of the present application and the pencils can be fed into and withdrawn from the sharpener automatically during the sharpening.

According to the pencil sharpener of the present application, ends of the actuation shafts supporting the feeding rubber tyres may be supported by arc guides in a pair of vertical fixed walls. Thus, the feeding gear set and the gearing branch can keep engaged with each other when the interval of the actuation shafts is varied, so that the structure of the feeding member is simplified greatly.

According to the pencil sharpener of the present application, the pencil may be fed vertically and wastes produced by sharpening the pencil may drop into the waste box directly to keep the environment clean while no waste will be stacked in the sharpening member.

According to the pencil sharpener of the present application, a tenon for positioning the waste box initially may be provided on the bottom plate. The waste box may be connected to the support via a buckle. A button for removing the waste box may be provided in the support so as to facilitate the removing of the waste box to clean the waste therein.

According to the pencil sharpener of the present application, a fixing member may be further provided at bottom thereof. The fixing member may comprise an adjusting rod and a fixing plate mounted to the adjusting rod via a sleeve. The distance between the bottom of the pencil sharpener and the fixing plate may be adjusted by a knob so that the pencil sharpener can be used on a desk and the crank can be rotated conveniently with a small force.

According to the pencil sharpener of the present application, a rotating cover may be mounted in an upper cover of the housing, and a plurality of openings with various diameters may be provided in the rotating cover for receiving pencils of various sizes. When a pencil is required to be sharpened, the user only needs to rotate the rotating cover to make the opening corresponding to the diameter of the pencil to be aligned with the feeding opening of the feeding member. Thus, pencils with various diameters can be sharpened easily and conveniently.

DRAWINGS

Hereinafter, the present application will be described in detail with reference to embodiments and accompanying drawings, in which.

DETAILED DESCRIPTION

Figure 1:
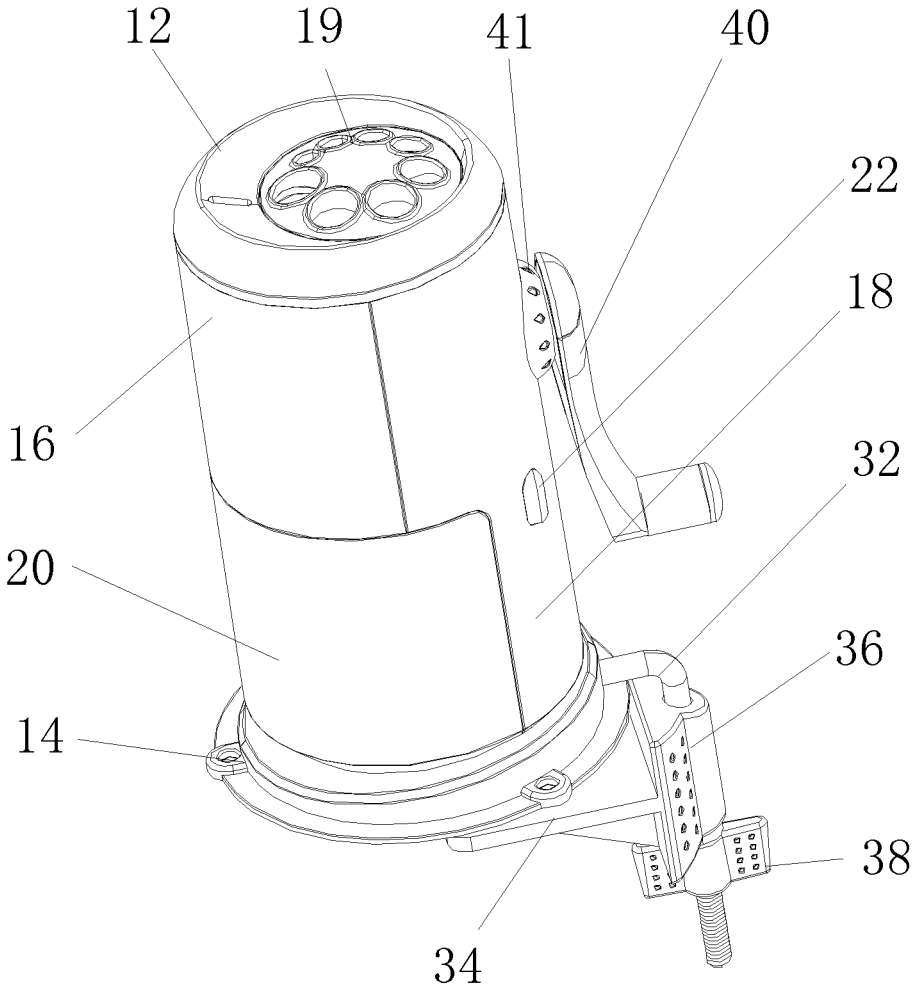
FIG. 1 shows an elevation view of the pencil sharpener according to an embodiment of the present application.

Referring to FIG. 1, a hand-cranked pencil sharpener comprises a housing, a rotating cover 19 having a plurality of openings and being provided on a top of the housing, a crank 40 provided on a side of the housing, a fixing member provided on a bottom of the housing. The hand-cranked pencil sharpener further comprises a feeding member 70, a sharpening member 90 and a waste box 20 arranged in the housing from top to bottom in sequence. Using such a hand-cranked pencil sharpener, a pencil is fed into the sharpening member 90 by the feeding member 70 along a vertical feeding path so that the pencil is sharpened by the sharpening member 90 and the generated waste is dropped into the waste box 20. When the pencil is inserted into one of the openings in the rotating cover 19, the cranked 40 can be rotated by hand so as to sharpen and then withdraw the pencil. In such a configuration, the pencil is sharpened with a less affection caused by manual operations, so that the sharpening quality is improved. Meanwhile, the structure of the feeding member is simplified.

In the hand-cranked pencil sharpener according to this embodiment, the pencil is fed vertically. In addition, a removable waste box 20 is arranged under the sharpening member so that the generated waste by the sharpening may be dropped into the waste box 20 directly. Thus, the waste will not be stacked in the sharpening member 90 so as to keep the environment clean.

The gearing member may comprise a gearing branch 66 for moving the feeding member 70. The linkage of the gearing branch 66 and the feeding member automatically feeds the pencil into the sharpening member or automatically withdraws the pencil from the sharpening member, in response to the crank 40 rotating clockwise or counterclockwise.

The feeding member comprises a feeding gear set driven by the gearing branch 66, and a pair of feeding rubber tyres 84, 86 supported by actuation shafts 78, 79, respectively, and driven by the feed gear set. The actuation shafts 78, 79 are connected to each other at each end thereof via a resilient member 80. The interval between the feeding rubber tyres 84, 86 is adjustable due to the resilience of the resilient member 80, so that pencils of various diameters can be inserted.

Figure 2:
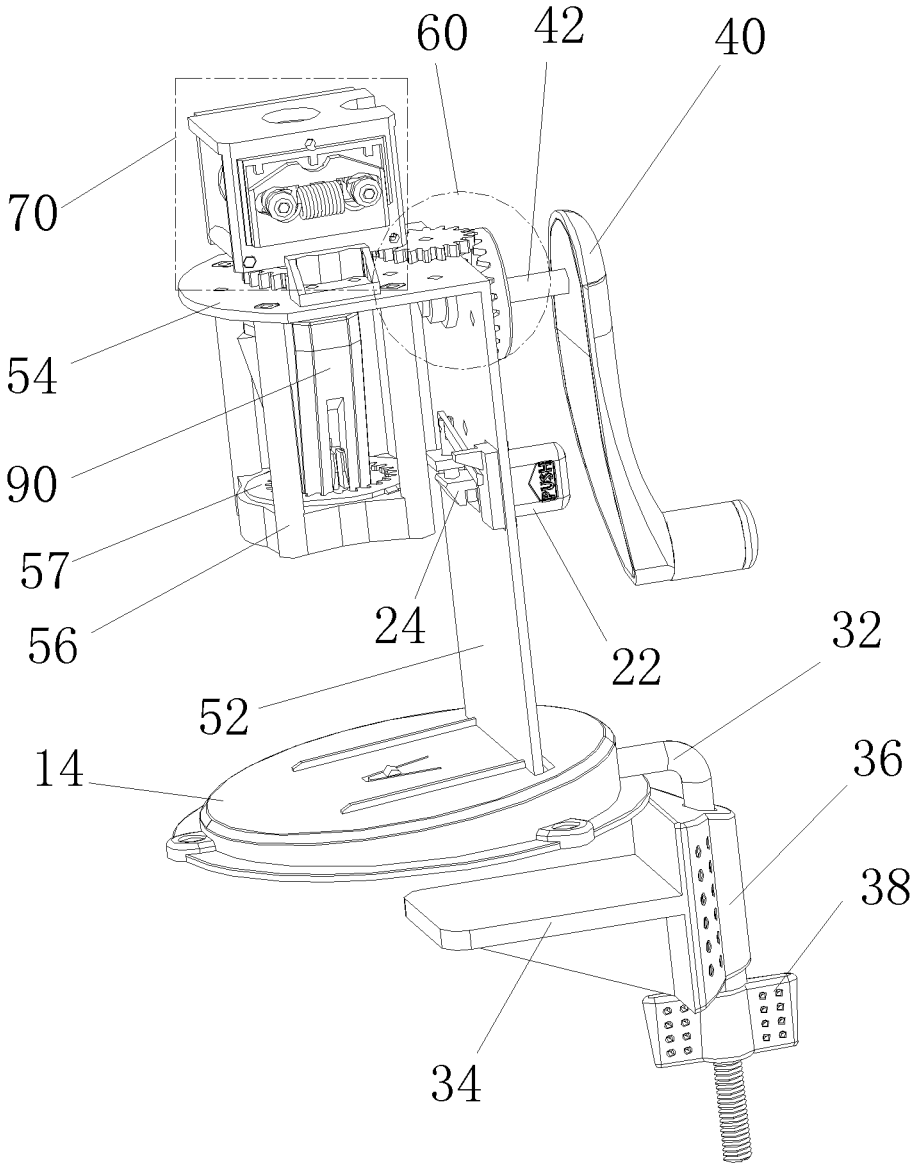
FIG. 2 shows the inner structure of the pencil sharpener according to an embodiment of the present application which is viewed from a direction.
Figure 3:
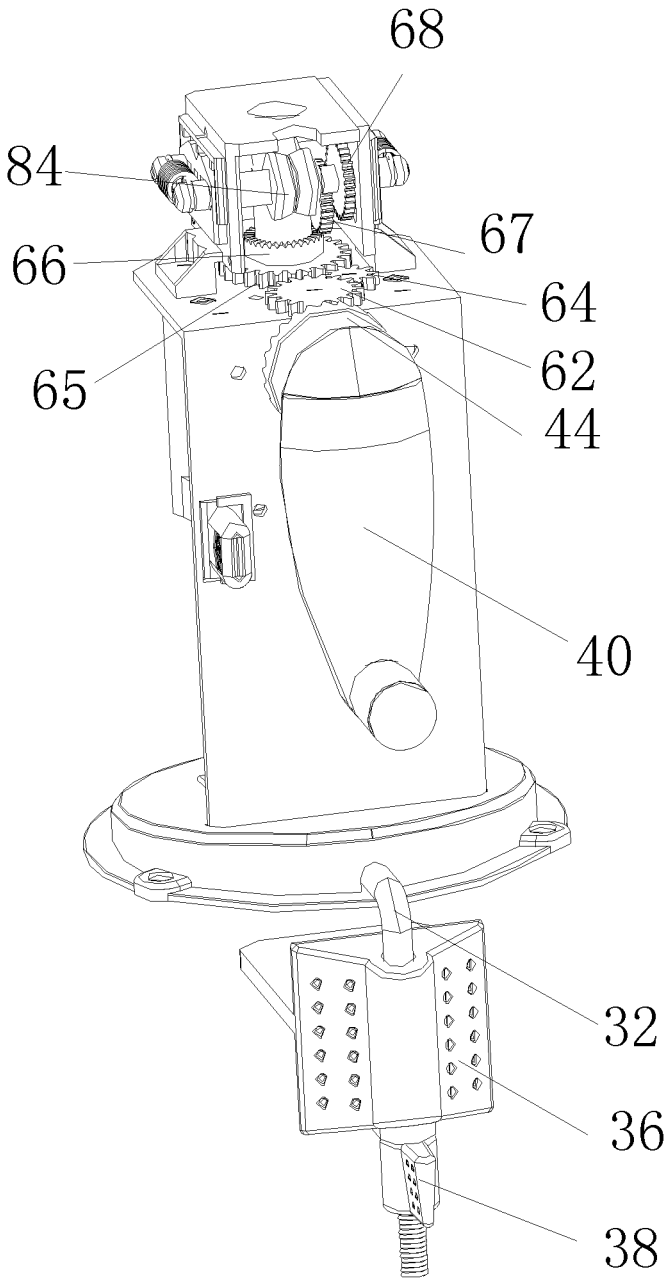
FIG. 3 shows the inner structure of the pencil sharpener according to an embodiment of the present application which is viewed from another direction.
Figure 4:
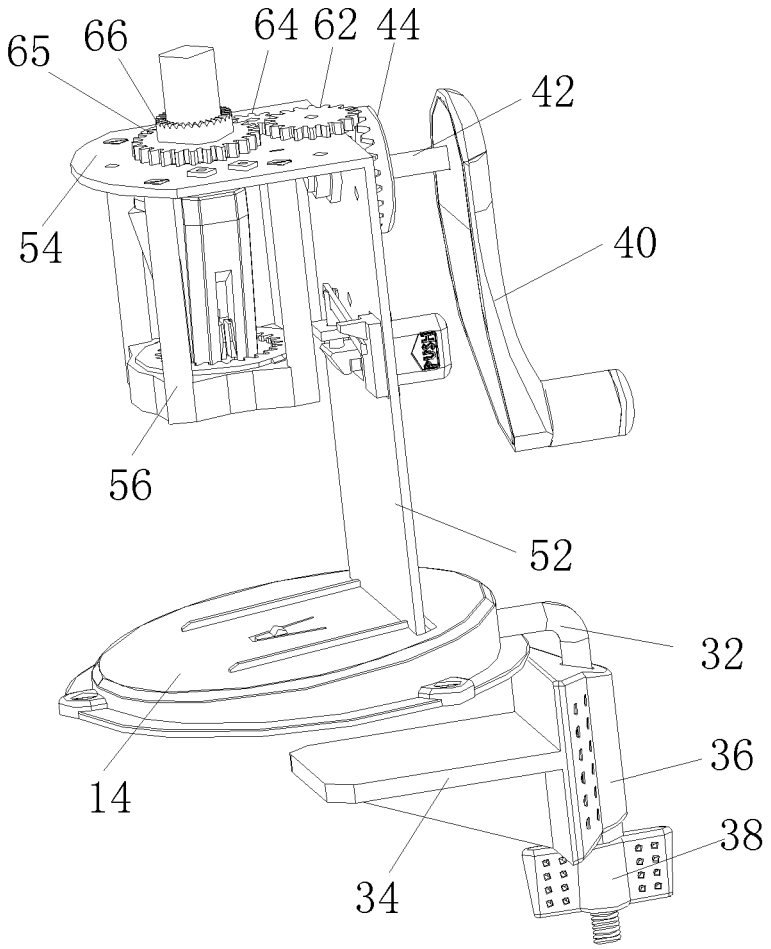
FIG. 4 shows a simplified view of the inner structure of the pencil sharpener according to an embodiment of the present application.

Referring to FIGS. 2-4, the hand-cranked pencil sharpener will be described in detail.

The housing is configured to enclose the feeding member 70, the sharpening member 90 and the waste box 20 and also acts as a decoration. In particular, the housing may comprise an upper cover 12, a front housing 16 and a rear housing 16. The rotating cover 19 is installed to the upper cover 12 by rotation. The openings on the rotating cover 19 have various diameters corresponding to those of pencils of various sizes.

Since a plurality of openings whose diameters are corresponding to those of pencils of various sizes, when a pencil is to be sharpened, the user only needs to rotate the rotating cover 19 to align the desired opening whose diameter is corresponding to the pencil to be sharpened with a feeding opening 76 of the feeding member and then rotate the crank, which is easy and convenient.

A bottom plate 14, a support 52 extending upward from the bottom plate 12, a division plate 54 parallel to the bottom plate 14, and a bracket 56 extending downward from the division plate 54 may be contained in the housing. The feeding member 70 may be mounted above the division plate 54. The sharpening member 90 may be installed in the bracket 56.

The waste box 20 may be connected to the support 52 via a buckle 24. A button 22 for removing the waste box 20 may be provided on the support 52. A slot may be provided on the rear portion 18 of the housing and the button 22 extends from the slot. A tenon (not shown) may be arranged on the bottom plate 14 for positioning the waste box 20 initially. In this example, the waste box 20 is initially positioned by the tenon on the bottom plate 14 and connected to the support 52 via the buckle 24; and the button 22 is provided on the support 52 for removing the waste box 20. Thus, the waste box 20 is easily to be removed and cleaned.

Figure 7:
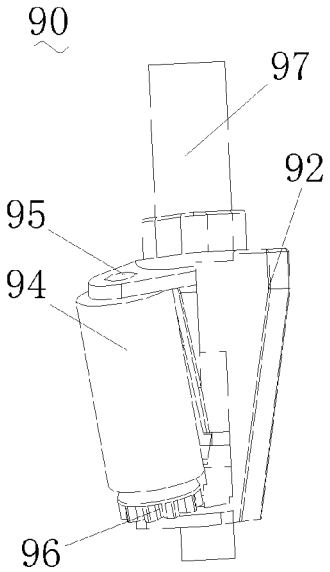
FIG. 7 shows a sharpening member of the pencil sharpener according to an embodiment of the present application.

Referring to FIG. 7, the gearing member 60 may comprise a connection shaft 42 connected to the crank 40, a first gear 44, a second gear 62, a third gear 64 and a fourth gear 65. The fourth gear 65 is fixed on a connection portion 97 at an end of a toolrest 92. The fourth gear 65 is upward arranged to serve as a crown gear for the gearing branch 66. A through-hole (not shown) is provided in the center of the connection portion 97 for fixing the fourth gear 65, through which the pencil can be inserted into the sharpening member 90. In operation, the crank 40 is rotated and the rotation of the crank 40 brings the connection shaft 42, the first gear 44, the second gear 62, the third gear 64 and the fourth gear 65 to rotate in turn so as to make the toolrest 92 to revolve.

The sharpening member 70 may comprise a hob 94 and the toolrest 92 which is rotated by the fourth gear 65. An inner gear 57 is mounted at the bottom of the bracket 56. A pinion 96 and a hob shaft 95 are fixed at the bottom of the hob 94. The hob 94 is fitted to the hob shaft 95. The pinion 96 is arranged at the bottom of the hob 94 and is engaged with the inner gear 57. When the hob 94 rotates as the toolrest 92 rotates, the hob 94 is brought to rotate due to the engagement of the pinion 96 and the inner gear 57. Therefore, the hob 94 revolves as the toolrest 92 rotates, and is rotated by the pinion 96 for sharpening the pencil.

Figure 5:
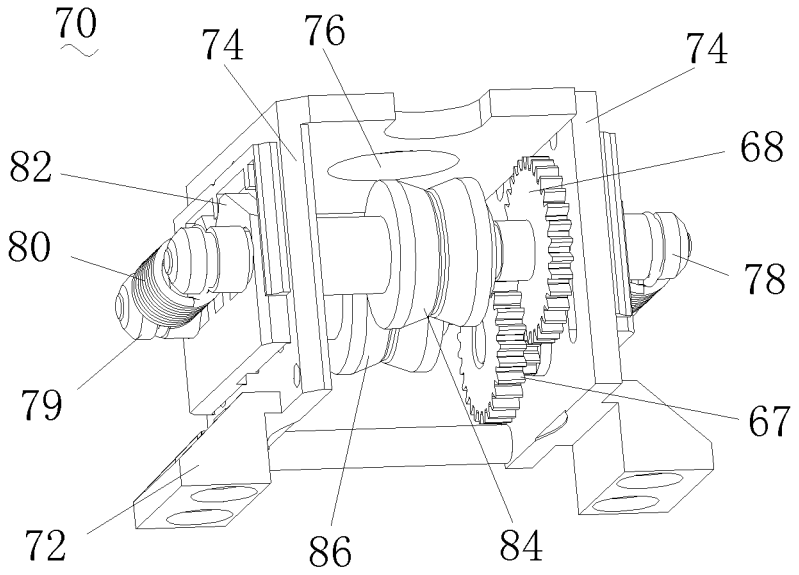
FIG. 5 shows a feeding member of the pencil sharpener according to an embodiment of the present application.
Figure 6:
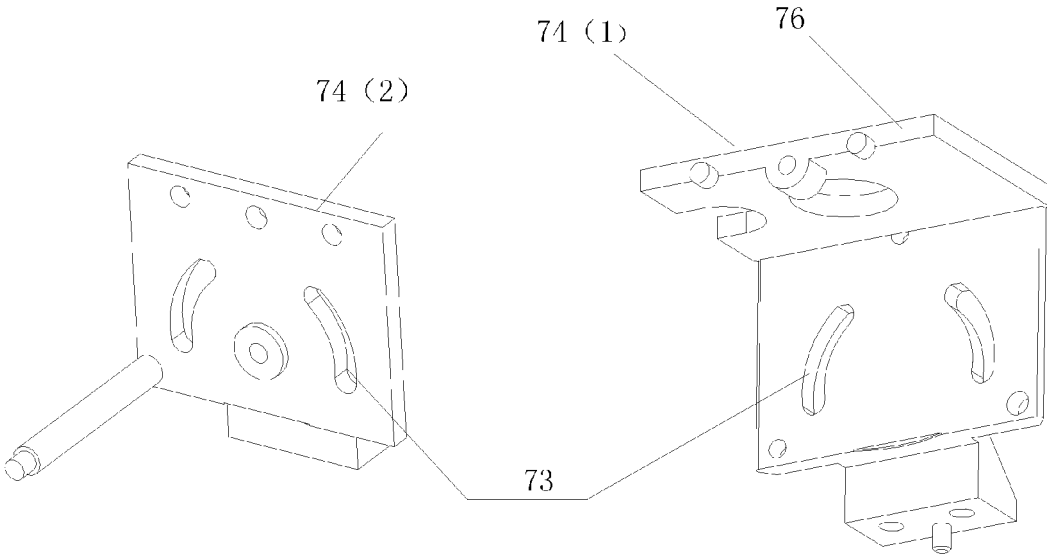
FIG. 6 shows an exploded view of left and right gear boxes of the pencil sharpener according to an embodiment of the present application, in which arc guides are shown.

Referring to FIGS. 5-6, the feeding member comprises a gear box, actuation shafts 78, 79 received in the gear box for supporting the feeding rubber tyres 84, 86, a slider 82 being housed at ends of the actuation shafts 78, 79, and a feeding gear set driven by the gearing branch 66.

The gear box comprises a left box 74(1) and a right box 74(2) connected to each other via a top plate (not shown). The left box 74(1) and the right box 74(2) are mounted on the division plate 54 via a base 72 arranged at the bottom thereof. A feeding opening 76 aligned with a midline of the two feeding rubber tyres 84, 86 is provided on the top plate. Arc guides 73 are arranged in the left box 74(1) and the right box 74(2) for receiving the actuation shafts 78, 79. The interval between the actuation shafts 78, 79 varies under constrain of the arc guides 73. The arc guides 73 are provided so that a second feeding gear 68 and a duplex feeding gear 67 can keep engaged with each other when the horizontal interval between the actuation shafts 78, 79 varies. Thus, the rotation will be transmitted to the second feeding gear 68 regardless of the size of the pencil being sharpened.

The actuation shafts 78, 79 for supporting the feeding rubber tyres 84, 86 are connected to each other via a resilient member 80 such as a tension spring in this example. In this example, the resilient member 80 is connected to ends of the actuation shafts 78, 79 outside the left box 74(1) and the right box 74(2). Alternatively, the resilient member 80 may connect the actuation shafts 78, 79 in the left box s. The interval between the feeding rubber tyres 84, 86 is adjusted by the resilience of the resilient member 80 so that pencils having various diameters can be inserted.

A horizontal sliding groove is provided in the slider for receiving the actuation shafts 78, 79. The slider 82 is provided so that the two actuation shafts 78, 79 will keep in a same horizontal position when approaching or separating from each other under the constrains of the arc guides 73 and thus move synchronously upwards and downwards. Preferably, two sliders 82 are provided at both ends of the actuation shafts 78, 79 to connect the actuation shafts 78, 79 with each other. Alternatively, only one slider 82 may be provided at one end of the actuation shafts 78, 79 to connect the actuation shafts 78, 79 with each other.

The feeding gear set may comprise the duplex feeding gear 67 and a second feeding gear 68. The duplex feeding gear 67 is fixed on the left box 74(1) and is engaged with the crown gear of the fourth gear 65 in the gearing branch 66. The second feeding gear 68 is fixed on the actuation shaft 78 or 79. In this embodiment, the second feeding gear 68 is fixed on the actuation shaft 78 supporting the feeding rubber tyre 84 and is engaged with the duplex feeding gear 67. The second feeding gear 68 transmits the rotation of the crank 40 to the actuation shaft 78 and brings the actuation shaft 78 to rotate when the pencil is slightly clamped between the feeding rubber tyres 84, 86 so that the actuation shaft 79 is also brought to rotate by the friction force between the pencil and the feeding rubber tyres 84, 86. Therefore, the rotating feeding rubber tyre 84 serves as a driving wheel and the driven feeding rubber tyre 86 serves as a driven wheel. The pencil is thus fed in the sharpening member 90 by the friction force.

When the pencil is inserted through the opening of the rotating cover 19 and the feeding opening 76, it will be clamped between the two feeding rubber tyres 84, 86 with a slight force. The resilient member 80 is stretched when the pencil is inserted between the feeding rubber tyres 84, 86. Meanwhile, the resilient member 80 applies a pressure on the pencil to form a pre-tightening force for feeding the pencil. When the feeding rubber tyre 84 rotates as a driving wheel, the feeding rubber tyre 86 rotates accordingly as a driven wheel so as to feed the pencil. The pencil can be withdrawn only if the crank 40 is turned in the opposite direction. A certain distance is kept between the feeding rubber tyres 84, 86 so that a pre-tightening force will be generated between the feeding rubber tyres 84, 86 and the pencil so as to produce the friction force. In such a configuration, the feeding rubber tyres 84, 86 can rotate together to feed or withdraw the pencil. In order to feed and withdraw pencils of various diameters by the feeding rubber tyres 84, 86, the shaft distance between the feeding rubber tyres 84, 86 shall be adjusted so as to ensure a certain pre-tightening force between the feeding rubber tyres 84, 86 and the inserted pencil regardless of the diameter of the pencil. A pre-tightening force which is too large or too small will not ensure that the pencil will be sharpened properly.

Since the pre-tightening force should be maintained in a certain range and the pencil cannot be fed and withdrawn effectively if the pre-tightening force is too large or too small, the sharpening range of the pencil should also be limited in a certain range. To do this, resilient members 80 having different resilient forces are designed for pencils with different diameters.

In order to facilitate the rotating of the crank 40, the pencil sharpener may be fixed on a flat desk. The bottom plate 14 of the housing may be combined with a fixing member. In this case, the pencil sharpener can be fixed on the desk by a fixing member so that the crank 40 can be rotated conveniently with less force.

The fixing member may comprise an adjusting rod 32 connected to the bottom plate 14, a fixing plate 34 mounted on the adjusting rod 32 via a sleeve 36, and a knob 38 for adjusting the distance between the bottom plate 14 of the pencil sharpener and the fixing plate 34. The adjusting rod 32 is provided with external threads matching with the inner threads of the knob 38. The fixing plate 34 can slide on the adjusting rod 32 so as to be adaptive to clamp fixed plats with various thicknesses. When the bottom plate 14 and the fixing plate 34 clamp the fixed plats therebetween, the pencil sharpener can be fixed to the desk or other plats conveniently by rotating the knob 38.

Hereinabove, embodiments of the present application have been described. It will be obvious that various modifications and changes may be made thereto without departing from the broader spirit and scope of the invention as set forth in the appended claims. The specification and drawings are, accordingly, to be regarded in an illustrative sense rather than a restrictive sense.

The invention claimed is:

1. A hand-crank pencil sharpener, comprising a housing, a gearing member and a sharpening member, the gearing member and the sharpening member being installed within the housing, and the gearing member being connected to a hand crank and transmitting a rotation of the crank to the sharpening member, wherein the sharpener further comprises a feeding member arranged in the feeding path, and wherein the gearing member comprises a gearing branch for driving the feeding member, and the inserted pencil is fed into or withdrawn from the sharpener automatically by a linkage of the gearing branch and the feeding member when the crank is rotated clockwise or counterclockwise, wherein the feeding member comprises a feeding gear set driven by the gearing branch and a pair of feeding rubber tyres driven by the feeding gear set, the pair of feeding rubber tyres are mounted on two actuation shafts, respectively, the actuation shafts are connected by at least one resilient member for adjusting an interval between the feeding rubber tyres so that pencils having diameters different from one another are able to be inserted and pre-tightened.

2. The hand-crank pencil sharpener of claim 1, wherein the resilient member connects ends of the actuation shafts, and a feeding opening is provided in the feeding member aligned with a midline of the pair of feeding rubber tyres.

3. The hand-crank pencil sharpener of claim 2, wherein each of the actuation shafts is supported by arc guides in a pair of vertical fixed walls, and the feeding member further comprises a slider for keeping the actuation shafts in a same horizontal position when they move upwards or downwards to adapt for pencils having diameters different from one another.

4. The hand-crank pencil sharpener of claim 3, wherein the housing comprises a bottom plate, a support extending upward from the bottom plate, and a division plate parallel with the bottom plate, wherein the feeding member is positioned above the division plate, the sharpening member is positioned under the division plate, the waste box is connected with the support via a buckle, and a button for removing the waste box is provided on the support.

5. The hand-crank pencil sharpener of claim 4, wherein a tenon is provided on the bottom plate for positioning the waste box initially.

6. The hand-crank pencil sharpener of claim 5, wherein a rotating cover is mounted in an upper cover of the housing, and a plurality of openings having diameters different from one another are provided in the rotating cover for receiving pencils of various sizes.

7. The hand-crank pencil sharpener of claim 2, wherein the housing comprises a bottom plate, a support extending upward from the bottom plate, and a division plate parallel with the bottom plate, wherein the feeding member is positioned above the division plate, the sharpening member is positioned under the division plate, the waste box is connected with the support via a buckle, and a button for removing the waste box is provided on the support.

8. The hand-crank pencil sharpener of claim 1, further comprising a removable waste box under the sharpening member.

9. The hand-crank pencil sharpener of claim 8, wherein the housing comprises a bottom plate, a support extending upward from the bottom plate, and a division plate parallel with the bottom plate, wherein the feeding member is positioned above the division plate, the sharpening member is positioned under the division plate, the waste box is connected with the support via a buckle, and a button for removing the waste box is provided on the support.

10. The hand-crank pencil sharpener of claim 1, wherein a fixing member is combined with a bottom of the hand-crank pencil sharpener, wherein the fixing member comprises an adjusting rod, a fixing plate mounted on the adjusting rod via a sleeve, and a knob for adjusting a distance between the bottom of the pencil sharpener and the fixing plate.

11. The hand-crank pencil sharpener of claim 10, wherein the housing comprises a bottom plate, a support extending upward from the bottom plate, and a division plate parallel with the bottom plate, wherein the feeding member is positioned above the division plate, the sharpening member is positioned under the division plate, the waste box is connected with the support via a buckle, and a button for removing the waste box is provided on the support.

12. The hand-crank pencil sharpener of claim 1, wherein the housing comprises a bottom plate, a support extending upward from the bottom plate, and a division plate parallel with the bottom plate, wherein the feeding member is positioned above the division plate, the sharpening member is positioned under the division plate, the waste box is connected with the support via a buckle, and a button for removing the waste box is provided on the support.

13. The hand-crank pencil sharpener of claim 12, wherein a tenon is provided on the bottom plate for positioning the waste box initially.

14. The hand-crank pencil sharpener of claim 13, wherein a rotating cover is mounted in an upper cover of the housing, and a plurality of openings having diameters different from one another are provided in the rotating cover for receiving pencils of various sizes.

15. The hand-crank pencil sharpener of claim 1, wherein the feeding gear set comprises a duplex feeding gear and a second feeding gear, the second feeding gear being fixed on an end of one of the actuation shafts for the feeding member, and the duplex feeding gear being engaged with the second feeding gear and driven by the gearing branch.

16. The hand-crank pencil sharpener of claim 1, wherein the housing comprises a bottom plate, a support extending upward from the bottom plate, and a division plate parallel with the bottom plate, wherein the feeding member is positioned above the division plate, the sharpening member is positioned under the division plate, the waste box is connected with the support via a buckle, and a button for removing the waste box is provided on the support.

17. The hand-crank pencil sharpener of claim 16, wherein a tenon is provided on the bottom plate for positioning the waste box initially.

18. The hand-crank pencil sharpener of claim 17, wherein a rotating cover is mounted in an upper cover of the housing, and a plurality of openings having diameters different from one another are provided in the rotating cover for receiving pencils of various sizes.

* * * * *